United States Patent [19]

Johnson

[11] Patent Number: 4,770,083

[45] Date of Patent: Sep. 13, 1988

[54] INDEPENDENTLY ACTUATED PRESSURE RELIEF SYSTEM

[75] Inventor: Steven H. Johnson, Dubuque, Iowa

[73] Assignee: Deere & Company, Moline, Ill.

[21] Appl. No.: 16,320

[22] Filed: Feb. 19, 1987

[51] Int. Cl.[4] ..... F15B 11/08

[52] U.S. Cl. ..... 91/441; 91/461; 414/699

[58] Field of Search ..... 414/694, 699; 60/592; 91/304, 461, 441

[56] References Cited

U.S. PATENT DOCUMENTS

| | | | |
|---|---|---|---|
| 3,474,824 | 10/1969 | Roy et al. . | |
| 3,543,516 | 5/1969 | Treichel . | |
| 3,785,157 | 1/1974 | Kittle et al. . | |
| 3,943,824 | 3/1976 | Fletcher . | |
| 3,995,425 | 12/1976 | Wittren . | |
| 4,376,612 | 3/1983 | Yeou | 414/694 |
| 4,625,749 | 12/1986 | Eskildsen . | |

FOREIGN PATENT DOCUMENTS

| | | | |
|---|---|---|---|
| 80037 | 3/1983 | Japan | 414/694 |
| 195636 | 11/1983 | Japan | 414/694 |
| 52031 | 3/1984 | Japan | 414/694 |
| 920129 | 4/1982 | U.S.S.R. | 414/694 |

OTHER PUBLICATIONS

Rexroth Worldwide Hydraulics, Components for Hydraulic Proportional & Servo Systems, Electronics & Accessories, p. 181.

Ansi Graphic Symbols for Fluid Power Diagrams.

*Primary Examiner*—Robert J. Spar

*Assistant Examiner*—Donald W. Underwood

[57] ABSTRACT

A pressure relief system for the primary hydraulic system of a large industrial machine wherein the biasing force biasing one of the pressure relief valves is supplied by the pilot hydraulic control system of the machine. A two-position valve is used to selectively change the biasing force in response to a temperature indicator. The two-position valve couples and decouples the pressure relief valve to and from the pilot control system hydraulic pump and the pilot hydraulic system sump. If the pressure relief valve is in communication through the two-position valve with the pilot hydraulic fluid sump, the biasing force is reduced against the pressure relief valve and the pressure in the primary hydraulic system opens the pressure relief valve and directs hydraulic fluid to the primary hydraulic fluid sump.

5 Claims, 2 Drawing Sheets

Fig. 1
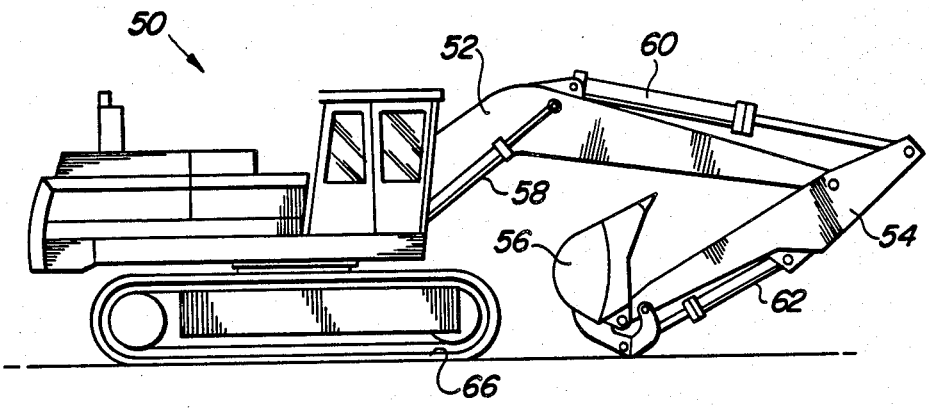
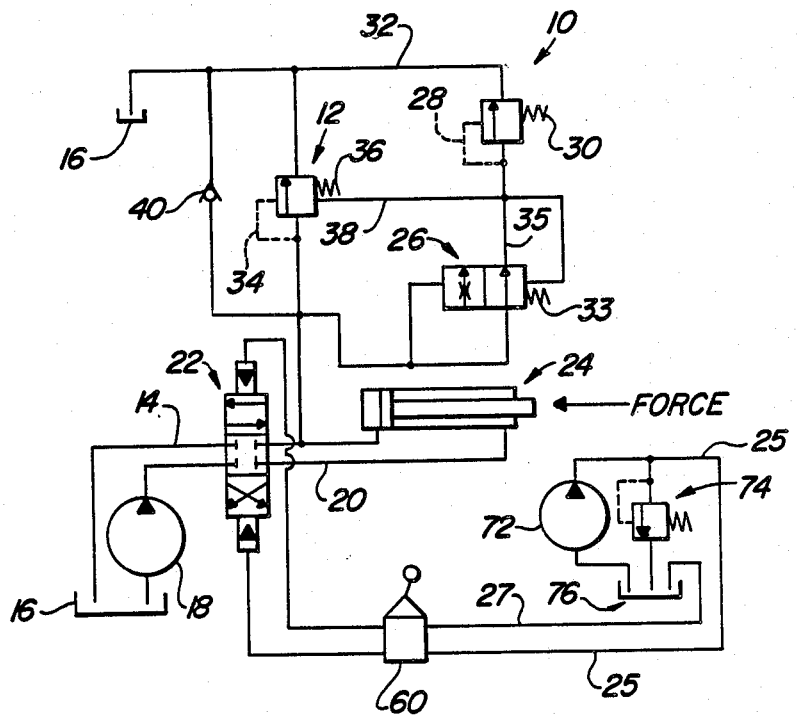
Fig. 2
(PRIOR ART)

INDEPENDENTLY ACTUATED PRESSURE RELIEF SYSTEM

BACKGROUND OF THE INVENTION

1. Field of the Invention

The invention is directed to a hydraulic system particularly adaptable for use with an excavator or other large earthmoving machines, having a hydraulic pressure relief system which can be independently actuated by the operator of the machine to reduce hydraulic line pressure and in turn reducing temperature.

2. Description of the Prior Art

Excavators and other earthmoving machines use hydraulic systems to power and locate numerous operative members, such as boom members, buckets, lifting members, dozer blades, etc. In addition, hydraulic systems can be used to drive the machines through hydrostatic drives. Forcing hydraulic fluid through valve bodies at high pressures drops increases the temperature of the fluid. The oil is heated while passing through the valve body in both the pumping path and the exhaust path. Typically, the exhaust oil is cooled after it passes the directional control valve in the hydraulic fluid sump on the machine. Normally, the sump will be provided with an oil cooler for assisting in this task.

Hydraulic pressure relief systems are well known and are used to protect the hydraulic system from overload by directing hydraulic fluid to the sump if excessive overpressure is developed. FIG. 2 illustrates such a system, wherein two pressure relief valves 10 and 12 are mounted in parallel between exhaust hydraulic line 14 containing a pressurized hydraulic fluid and hydraulic fluid sump 16. In operation, hydraulic fluid is pumped from sump 16 by pump 18 and directed by pumping line 20 through directional valve 22 to hydraulic motor 24. The exhausted hydraulic fluid is returned through line 14 to sump 16. Three-position directional valve 22 can be used to stop the flow through the hydraulic lines or redirect the flow from the pump in the lines downstream of the valve thereby effectively reversing the hydraulic motor. The positioning of valve 22 is controlled by a pilot hydraulic control system that forms a source of secondary hydraulic pressure. Hydraulic fluid from pump 72 directs fluid from sump 76 through line 25 to pilot control actuator 60. A second hydraulic line 27 is coupled to sump 76. By manipulating actuator 60, the positioning of valve 22 is controlled.

The hydraulic pressure relief system is also provided with a snubber valve 26 having a conventional port and a restricted orifice. If excessive hydraulic pressure is developed, the pressure of hydraulic fluid in sensing line 28 of first pressure relief valve 10 would overcome spring 30 opening this valve and releasing pressure through line 32 to sump 16. If the pressure continues to build, the second pressure relief valve would open, and as this is the bigger of the two valves, line 14 would effectively become depressurized. In opening the second pressure relief valve, snubber valve 26 is shifted to the right overcoming spring 33, so that the restricted orifice reduces the pressure in line 35 downstream of the snubber valve, this pressure drop caused by flow over the first pressure relief valve and reduces the biasing pressure on the second pressure relief valve to facilitate its opening. The excessive pressure is sensed through sensing line 34 of pressure relief valve 12 overcoming the biasing of spring 36 and the reduced hydraulic biasing of the fluid in hydraulic line 38 opening valve 12.

Anti-cavitation check valve 40 is provided to prevent cavitation in line 14 by allowing fluid to flow from sump 16 to this line.

SUMMARY OF THE INVENTION

The present hydraulic relief system can be independently actuated by a user before an overpressure situation occurs to better reduce heat added to the hydraulic fluid by eliminating its return flow through directional valve 22. To accomplish this result, biasing spring 30 of valve 10 is replaced with a hydraulic biasing system pressurized by a second source of pressurized fluid. Typically, in large earthmoving machines, this second source of pressurized hydraulic fluid can be supplied by the pilot hydraulic control system. An operator controlled two-position valve can then be used to couple or decouple this secondary source of pressurized hydraulic fluid to and from the first pressure relief valve 10. In this way, the hydraulic biasing force against the relief valve can be reduced, thereby opening this relief valve so that hydraulic fluid can be more readily directed to sump reducing pressure in the system thus reducing heat added to the fluid.

The two-position valve is preferably a spring biased solenoid controlled valve. Upon actuation of a switch by the operator, the hydraulic biasing line of the first pressure relief valve is decoupled from the pressurized pilot hydraulic line and coupled to the pilot relief sump. As such, the biasing force against the normally closed first relief valve is reduced and it is free to open in response to its hydraulic pressure sensing line.

BRIEF DESCRIPTION OF THE DRAWINGS

FIG. 1 is a side view of an excavator to which the present invention is particularly well adapted.

FIG. 2 is a hydraulic schematic of a prior art hydraulic pressure relief system.

DESCRIPTION OF THE PREFERRED EMBODIMENT

Figure 3:
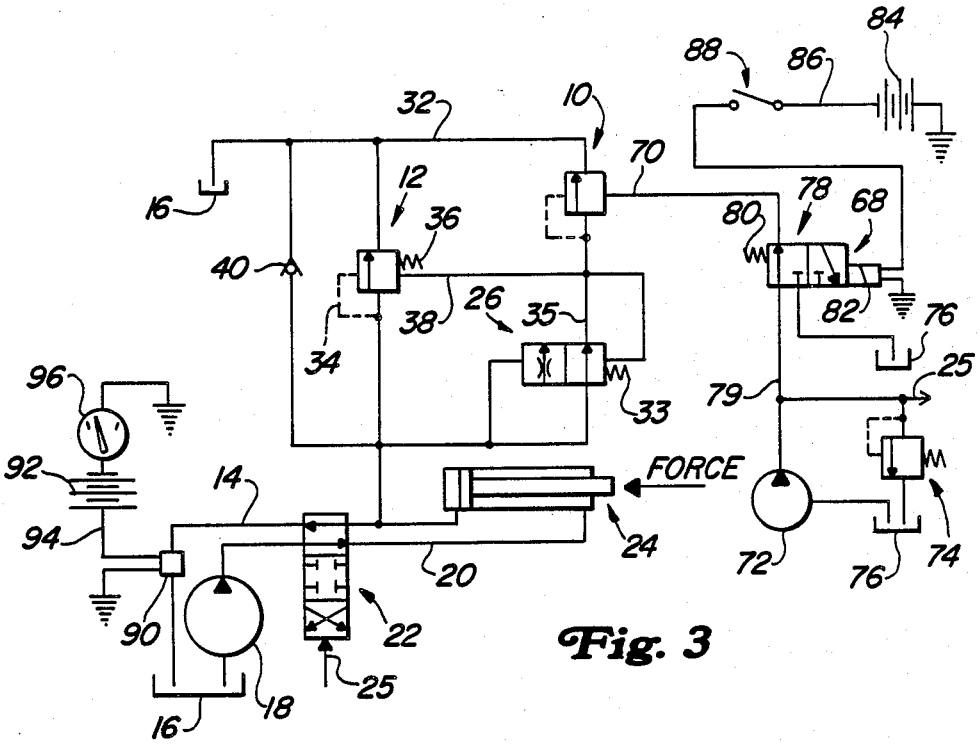
FIG. 3 is a hydraulic schematic of the subject hydraulic relief system wherein the relief valve is closed.

FIG. 1 is a side view of a self-propelled excavator 50 which is provided with a movable boom 52, dipper 54 and bucket 56. The boom, dipper and bucket are controlled by linear hydraulic motors 58, 60 and 62, respectively, which are identical to hydraulic motor 24 in form and function. The operator in cabin 64 controls the positioning of the various members by manipulating a series of levers which are operatively coupled by a pilot control system to a series of hydraulic valves which extend or retract the hydraulic motors. These control valves are identical to directional valve 22. In addition, the operator can move the excavator by actuating tracks 66 which are also hydraulically driven by a rotary hydraulic motor. Although the present invention can be utilized in any number of hydraulic applications, it is particularly useful in large earthmoving machines such as excavators. However, it should not be limited to these machines as it has a wider range of applications. In addition, the present invention can also be used in conjunction with rotary hydraulic motors.

The pilot control system is a hydraulic system independent of the main hydraulic system which is used to control the positioning of the directional valves of the main hydraulic system. As such, it is an intermediate system located between the operator's actuating lever and the main hydraulic system directional valves. Such systems are well known in the art and are used on large industrial machines, and as such is illustrated as arrow 25 in the figures.

Figure 4:
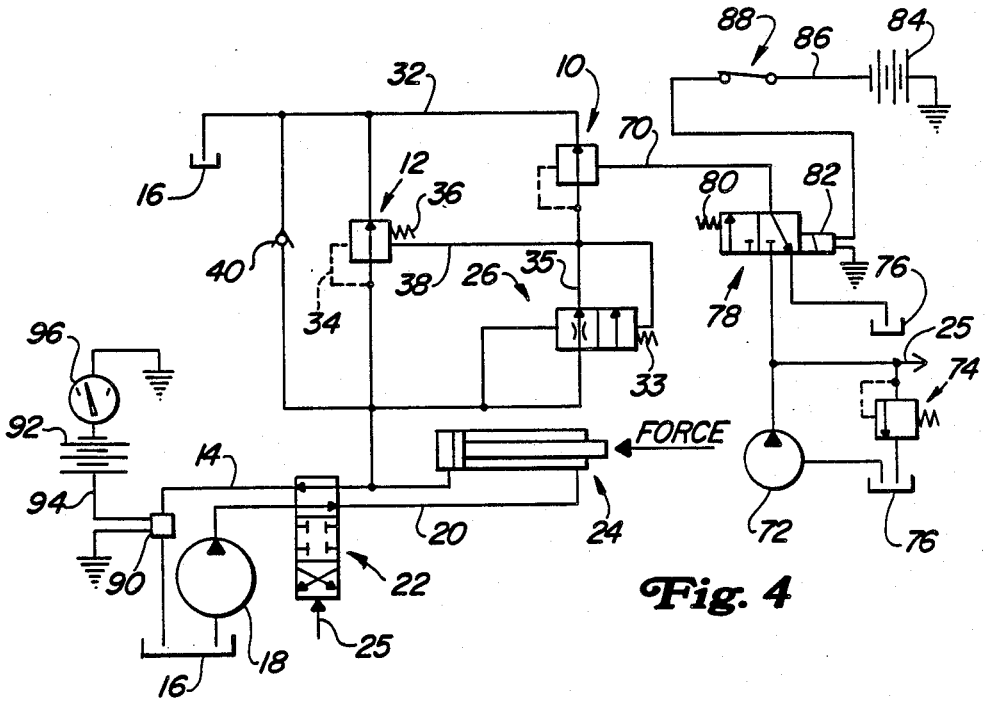
FIG. 4 is a hydraulic schematic of the subject hydraulic relief system wherein the relief valve is open.

FIGS. 3 and 4 illustrate the key features of the invention and are hydraulically identical to FIG. 2 except that biasing spring 30 of valve 10 has been replaced with a hydraulic biasing means 68 which is coupled to the pilot control system. The hydraulic biasing means comprises hydraulic line 70 containing a pressurized hydraulic fluid which biases pressure relief valve 10 into the closed position. The pressurized fluid in line 70 is formed by a second source of hydraulic pressure comprising the pilot control system. The pilot control system comprises a pilot hydraulic pump 72, pilot pressure relief valve 74 and sump 76. Two-position solenoid actuated valve 78 is positioned between line 70 and pilot hydraulic pump 72 and is used for coupling or decoupling the pilot system hydraulic pressure to valve 10. As illustrated in FIG. 3, when valve 78 couples pilot hydraulic fluid pressure line 79 to line 70, hydraulic fluid is directed to valve 10 forcing valve 10 closed. However, when valve 78 couples line 70 to the pilot hydraulic fluid sump 76, biasing pressure is reduced on valve 10 and it opens thereby connecting hydraulic line 14 with hydraulic sump 16 reducing pressure in line 14 and relieving opposing hydraulic pressure in hydraulic motor 24.

Valve 78 is spring biased into an open position by spring 80 against which solenoid 82 draws the valve when decoupling line 70 from the pilot hydraulic pressure. The solenoid is energized by electricity from electrical source 84 which is transmitted to solenoid 82 by wire 86. Switch 88 is used by the operator to selectively activate the solenoid.

Hydraulic pressure line 14 is also provided with a temperature sensor 90 which is coupled to electricity from electrical source 92 by wire 94. A meter or indicator 96 is used to alert an operator of the machine as to the temperature of the hydraulic fluid and whether it is overheating. If the fluid is overheating, the operator may elect to actuate switch 88 thereby opening valve 10 and reducing the pressure drop and temperature in line 14 accordingly.

It should be noted, that when valve 10 is open, hydraulic motor 24 only moves positively in one direction because as the movement direction is reversed by shifting directional valve 22, pumping line 20 is now connected to the opened pressure relief valve 10 and hydraulic fluid is pumped directly to sump 16 rather than hydraulic motor 24. Therefore, when hydraulic motor 24 must be positively moved in the reverse direction, switch 88 must be opened so that valve 10 is again closed. Many times, it is unnecessary to close valve 10 if the weight of the machine can reverse the hydraulic motor itself. For example, with an excavator, the boom must be positively lifted by hydraulic motor 58, but will passively fall due to its weight as direction valve 22 is reversed. This is especially helpful when the excavator is used in conjunction with a compaction roller. The compaction roller is typically mounted to the end of the bucket and as arm 54 is moved away from the machine, the boom is lifted, and the compacting roller moves outwardly; and as the arm is reversed, the boom floats or falls, moving the compaction roller inwardly.

In some applications, temperature sensor 90 maybe directly coupled to switch 88 so that switch 88 is automatically closed when the temperature in hydraulic line 14 exceeds a predetermined level, thereby acting as a thermostat. In such an application, a manual override switch would be necessary to override the temperature sensor and open switch if reverse positive movement of the motor was required.

The subject invention should not be limited by the above-described embodiments, but should be limited solely by the claims that follow.

I claim:

1. A large industrial machine having a primary hydraulic system for actuating operative members, the primary hydraulic system is provided with a primary hydraulic pump, a primary hydraulic motor, a directional control valve, a primary hydraulic fluid reservoir, and at least two primary hydraulic lines; one of the primary lines couples the primary pump to the primary motor through the directional control valve and the other primary line couples the primary reservoir with the primary motor through the directional control valve; the primary pump forming a primary source of pressurized hydraulic fluid; a pilot hydraulic control system is used to control the position of the directional control valve, the pilot hydraulic control system is provided with a secondary hydraulic pump forming a secondary source of pressurized fluid and a secondary hydraulic fluid reservoir; the primary hydraulic system is further provided with a pressure relief system comprising at least one pressure relief valve which is in fluidic communication with one of the two primary lines between the primary motor and the directional control valve, and the primary reservoir; the pressure relief valve is provided with a biasing means having a biasing force for normally biasing the pressure relief valve into a closed position, the improvement comprising:

coupling the pilot hydraulic control system to the pressure relief valve to form the biasing means so that the pressure relief valve is biased into a closed position by the pressure of the secondary hydraulic system, the pilot hydraulic control system is provided with a solenoid actuated, two-position, three-way valve for coupling and decoupling the pressure relief valve to and from the secondary source of hydraulic pressure and the secondary reservoir, thereby regulating the biasing force directed to the first pressure relief valve.

2. A large industrial machine as defined by claim 1 further comprising a second pressure relief valve that is provided with a biasing means comprising a spring, and a pressure sensing means comprising a hydraulic line, the second pressure relief valve is in fluid communication with the primary line, the first pressure relief valve is in communication with, and the primary reservoir and in parallel with the first pressure relief valve.

3. A large industrial machine as defined by claim 2 further comprising a snubber valve which is coupled between the primary line and the first pressure relief valve, the snubber valve is a two-position valve having a restricted flow port position and an open flow port position for directing hydraulic fluid from the primary line to the first pressure relief valve, the snubber valve is provided with a line for sensing hydraulic pressure in the primary line which biases the snubber valve from the open port position to the restricted port position against a biasing spring and a pressure sensing line sensing the hydraulic pressure between the snubber valve and the first pressure relief valve.

4. A large industrial machine as defined by claim 3 wherein the biasing means of the second pressure relief valve further comprises a pressure sensing line for sensing the hydraulic pressure between the snubber valve and the first pressure relief valve which further tends to bias the second pressure relief valve closed.

5. A large industrial machine as defined by claim 4 further comprising an anti-cavitation check valve that is located in a hydraulic line between the primary pump and the primary reservoir and is mounted in parallel with the first and second pressure relief valves, the anti-cavitation check valve prevents hydraulic fluid from flowing from the primary pump directly to the primary reservoir while allowing the reverse flow of hydraulic fluid from the primary reservoir to the primary source of pressurized fluid in the hydraulic line on which it is located.

* * * * *